US008141636B2

(12) United States Patent
Speirs et al.

(10) Patent No.: US 8,141,636 B2
(45) Date of Patent: Mar. 27, 2012

(54) METHOD AND SYSTEM INTEGRATING THERMAL OIL RECOVERY AND BITUMEN MINING FOR THERMAL EFFICIENCY

(75) Inventors: Brian C. Speirs, Calgary (CA); James A. Dunn, Calgary (CA)

(73) Assignee: ExxonMobil Upstream Research Company, Houston, TX (US)

( * ) Notice: Subject to any disclaimer, the term of this patent is extended or adjusted under 35 U.S.C. 154(b) by 129 days.

(21) Appl. No.: 12/664,845

(22) PCT Filed: Jun. 13, 2008

(86) PCT No.: PCT/US2008/007437

§ 371 (c)(1),
(2), (4) Date: Dec. 15, 2009

(87) PCT Pub. No.: WO2009/025693

PCT Pub. Date: Feb. 26, 2009

(65) Prior Publication Data

US 2010/0175876 A1 Jul. 15, 2010

(30) Foreign Application Priority Data

Aug. 17, 2007 (CA) ..... 2597881

(51) Int. Cl.
*E21B 43/24* (2006.01)

(52) U.S. Cl. ..... 166/272.3; 166/57; 166/303

(58) Field of Classification Search ..... None
See application file for complete search history.

(56) References Cited

U.S. PATENT DOCUMENTS

| | | | |
|---|---|---|---|
| 4,212,353 | A | 7/1980 | Hall |
| 4,487,686 | A | 12/1984 | Gomi et al. |
| 4,554,148 | A | 11/1985 | Gomi et al. |
| 4,999,178 | A | 3/1991 | Bowman |
| 2005/0034852 | A1 | 2/2005 | Irwin, Jr. |
| 2007/0095536 | A1 | 5/2007 | Vinegar et al. |
| 2007/0111903 | A1 | 5/2007 | Engel et al. |

FOREIGN PATENT DOCUMENTS

| | | | |
|---|---|---|---|
| EP | 0 138 286 | B1 | 1/1988 |
| EP | 0 197 995 | B1 | 11/1988 |
| EP | 0 197 106 | B1 | 1/1989 |
| EP | 0 198 891 | B1 | 2/1989 |
| GB | 2 138 840 | A | 10/1984 |

OTHER PUBLICATIONS

Peachy et al., "Low Carbon Futures Carbonate Triangle and Conventional Heavy Oil-Lowest GHG Production Scenarios", Mar. 31, 2007, pp. 78-79, paragraph 3.4.1.

*Primary Examiner* — Zakiya W Bates
(74) *Attorney, Agent, or Firm* — ExxonMobil Upstream Research Company-Law Department

(57) ABSTRACT

Thermal oil recovery operations, such as SAGD, result in waste heat that is typically released to the environment. Bitumen mining operations require heat input for heating fluids used in the mining process. A method and system of recovering heat from a thermal recovery operation for use in bitumen mining operation may include a heated donor fluid from a thermal recovery operation which heats an acceptor fluid for use in bitumen mining via proximal heat exchange using a power cycle or heat exchange module, such as an ammonia and water based Kalina® Cycle.

26 Claims, 3 Drawing Sheets

METHOD AND SYSTEM INTEGRATING THERMAL OIL RECOVERY AND BITUMEN MINING FOR THERMAL EFFICIENCY

CROSS-REFERENCE TO RELATED APPLICATIONS

This application is the National Stage of International Application No. PCT/US2008/007437, filed 13 Jun. 2008, which claims priority from Canadian Patent Application number 2,597,881 which was filed on 17 Aug. 2007, which is incorporated herein by reference.

FIELD OF THE INVENTION

The present invention relates generally to a method and system for recovering and utilizing heat produced in a thermal oil recovery operation.

BACKGROUND OF THE INVENTION

Thermal operations for oil recovery, such as steam assisted gravity drainage (SAGD) or cyclic steam stimulation (CSS), produce large quantities of low temperature waste heat. Steam assisted gravity draining may typically involve a high temperature high pressure fluid to be sent below ground to recover oil. When the fluid returns to the surface, some of the heat has dissipated, but there still remains a large amount of low temperature waste heat that is released to the environment without further utilization. Initial heating of fluid may be accomplished using natural gas, either purchased or derived from on-site sources.

Certain thermal operations, some of which involve water re-use, may have no immediate heat sink available for re-using heat generated in the operation. Thus, low grade waste heat generated by the operation is typically discharged to the atmosphere. For example, a conventional SAGD operation may produce in the order of 30 MW of waste heat when hot glycol (60-80° C.) produced in the operation is cooled to about 30° C. In current economic terms, this quantity of waste heat translates into approximately $5 million per year.

Bitumen mining operations, as may be found in the oil sands in Alberta, Canada, require large quantities of low grade heat. In a conventional mining operation located proximal to a river, a significant amount of heat is required to raise the initial river water temperature (starting at about 2-15° C.) by approximately 30-40° C. to reach the desired process temperature (about 35-45° C.).

It is, therefore, desirable to provide a method and a system capable of obtaining and recovering waste heat to be advantageously utilized as an energy saving measure.

SUMMARY OF THE INVENTION

Integrating thermal methods of oil recovery that produce waste heat with bitumen mining operations that require low grade heat has been found to be an effective strategy that advantageously results in significantly reduced energy use.

In a first aspect described herein, there is provided a method of recovering heat from a thermal oil recovery operation for use in a bitumen mining operation. The method comprises accessing a heated donor fluid resulting from a thermal oil recovery operation; heating an acceptor fluid for use in a bitumen mining operation through proximal heat exchange with the heated donor fluid to produce a heated acceptor fluid; and directing the heated acceptor fluid to a bitumen mining operation.

Further, there is provided a system for using heat produced in a thermal oil recovery operation to heat a fluid for a bitumen mining operation. The system comprises a heat exchange module for transferring heat from a heated donor fluid produced in a thermal oil recovery operation to an acceptor fluid to produce a heated acceptor fluid for use in a bitumen mining operation, the heat exchange module being located proximal to the heated donor fluid; an input conduit along which the acceptor fluid flows to the heat exchange module; and an output conduit along which the heated acceptor fluid is directed from the heat exchange module to a bitumen mining operation.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures.

DETAILED DESCRIPTION

Figure 1:
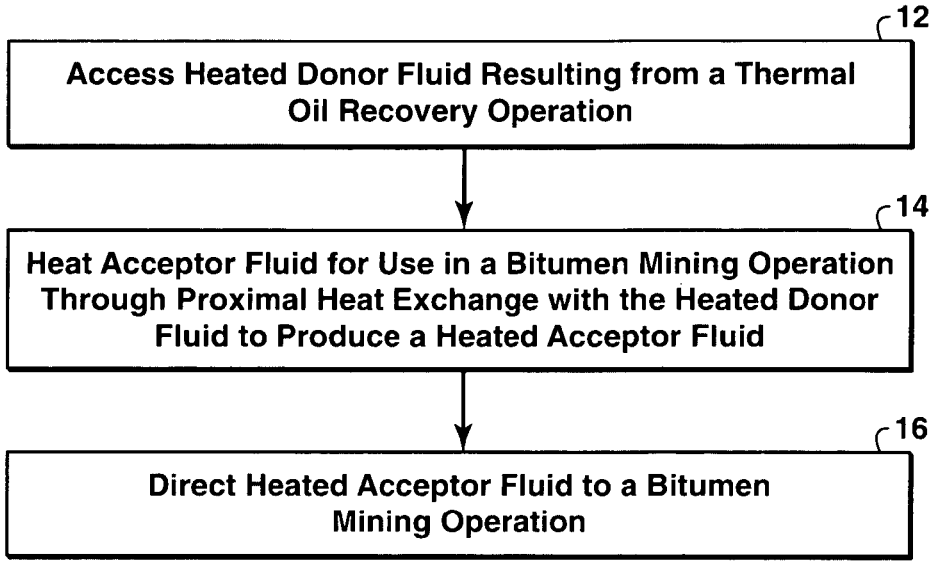
FIG. 1 is a schematic representation of the method described herein.

Generally, the present invention provides a method and system integrating and re-using waste heat from oil recovery operations for mining operations.

Integrating thermal methods of oil recovery that produce waste heat with bitumen mining operations that require low grade heat is an effective strategy that advantageously results in significantly reduced energy use. Waste heat from power cycles within a thermal oil recovery operation (for example, SAGD) can be used to preheat water or other fluids intended for mining extraction purposes in a bitumen mining operation.

A method of recovering heat from a thermal oil recovery operation for use in a bitumen mining operation is described. The method comprises accessing a heated donor fluid resulting from a thermal oil recovery operation; heating an acceptor fluid for use in a bitumen mining operation through proximal heat exchange with the heated donor fluid to produce a heated acceptor fluid; and directing the heated acceptor fluid to a bitumen mining operation.

A donor fluid is any fluid that may contain excess heat for donation, which otherwise may have gone to waste or been released to atmosphere in a conventional thermal recovery operation.

An acceptor fluid is a fluid that is requiring heat input to be heated at the level required for its use in a bitumen mining operation.

A thermal oil recovery operation is any oil recovery operation wherein heat energy is imparted to the oil, including, for example: steam assisted gravity drainage (SAGD); solvent assisted SAGD; cyclic steam stimulation (CSS); combined steam and vapor extraction process (SAVEX); steam flood; steam drive; solvent assisted CSS (such as Liquid Addition to Steam for Enhanced Recovery or: LASER); or an in situ combustion operation. SAGD is an exemplary type of recovery operation that will be discussed in more detail herein.

The heated donor fluid may comprise an aqueous solution under pressure such as, for example, a heated fluid derived from a wellbore in a SAGD operation. The heated donor fluid may be the entire effluent from the well, or have undergone some constituent separation prior to use in this method. The heated donor fluid may be mechanically lifted from a wellbore in a SAGD operation, for example, by using an artificial mechanical lift system such as a rod pump or rotary pump. The temperature of the heated donor fluid may range from 100 to 350° C., with an exemplary range being from 150 to 220° C.

The additional step of deriving heat from a supplemental heat donating source for heating the acceptor fluid may be included in the method. Such a supplemental heat donating source can be one derived from either a thermal oil recovery operation or a bitumen mining operation. For example, the supplemental heat donating source can be liquid phase blow down from a Once Through Steam Generator (OTSG); OTSG flue gas; or hot diluted bitumen.

The acceptor fluid may comprise water derived from a surface source, such as a river, as is conventionally the case in bitumen mining operations. Water may be derived from any useable surface, sub-surface or process-affected source. As water can be re-used, a small or large percentage of the acceptor fluid may comprise surface or sub-surface water, ranging from 5% to 100%, depending on the water recycling capacity and requirements of the mining operation.

The step of heating an acceptor fluid may comprise a power generating cycle, such as an Organic Rankine Cycle (ORC), an ammonia-water system, or expansion through a steam turbine. An exemplary ammonia-water system is the Kalina® Cycle, such as is used in some power generating operations unrelated to the oil recovery or mining industries. According to some embodiments, the Kalina® system for use in the instant method may involve deriving a heated donor fluid from SAGD production at a temperature of from 150-220° C. Power can be derived when ammonia-rich vapor is directed to a turbine. An acceptor fluid can be heated through heat exchange during condensation of ammonia-rich vapor. Further, a fluid produced from the heated donor fluid, after heat exchange with an ammonia-water mixture, may also be of an appropriate temperature and composition to be usable in a bitumen mining operation. The heated acceptor fluid, or other fluid produced from the heated donor fluid, may be transported by pipeline to the mining operation.

A system is provided for using heat produced in a thermal oil recovery operation to heat a fluid for a bitumen mining operation. The system comprises a heat exchange module for transferring heat from a heated donor fluid produced in a thermal oil recovery operation to an acceptor fluid to produce a heated acceptor fluid for use in a bitumen mining operation. In general, the heat exchange module is located proximal to the heated donor fluid, which may mean on or near the site of the thermal recovery operation; but could also be on or near the mining site. The system includes an input conduit, such as a pipeline, along which an acceptor fluid flows to the heat exchange module; and an output conduit, such as an additional pipeline, along which the heated acceptor fluid is directed from the heat exchange module to a bitumen mining operation.

According to this embodiment, the heat exchange module may comprise a power generating cycle, or any other module capable of direct or indirect exchange of heat between two fluids of disparate temperatures. In some instances, the heat exchange module is a power generating cycle that not only permits heat exchange, but also permits the generation of electrical power which may be used on site or sold.

In the instance where the power generating cycle is the Kalina® Cycle, the heat exchange module thus includes a condenser for condensing ammonia-rich vapor. The condenser receives the acceptor fluid from the input conduit, and produces heated acceptor fluid for release to the output conduit. The ammonia-rich vapor donates heat to the relatively cool acceptor fluid in order to drive the condensation process.

The system may be considered to include the thermal oil recovery operation, or can be considered separate from the thermal operation, for example, in those instances where a system is retro-fit to an existing operation.

Methods of thermal oil recovery operations resulting in excess heat being produced include steam assisted gravity drainage (SAGD); solvent assisted SAGD; cyclic steam stimulation (CSS); combined steam and vapor extraction process (SAVEX); steam flood; steam drive; solvent assisted CSS (such as Liquid Addition to Steam for Enhanced Recovery or: LASER); or in situ combustion operations. Each of these thermal oil recovery operations produces heat which may be re-used according to the invention instead of being lost to the environment. In SAGD operations, hot glycol is often used to run through a closed loop of heat exchangers.

SAGD integration with a bitumen mining operation is one embodiment that provides a venue for use of the excess heat produced in a SAGD operation, as a result of cooling hot glycol or other fluids. The excess heat can be captured and used in a bitumen mining operation, for example, to contribute to the heating of water or other fluids to the desired processing temperature. In an exemplary embodiment, the invention may be applied to the current aqueous extraction process; the temperature of the water to be heated is increased by bringing the water into proximity with the hot fluid to be cooled, so as to effect direct heat exchange. In other embodiments, a power cycle may be utilized so as to create not only a heated fluid for use in a mining operation, but also power in the form of electricity that can subsequently be used on site or sold.

A thermal operation can be built or adapted to channel the waste heat produced for use in heating water for bitumen mining. For example, existing SAGD operations could be retro-fit with the infrastructure required to integrate a system that captures the waste heat produced and utilizes it to heat water for a bitumen mining operation, and optionally to generate power.

The locations of the thermal oil recovery operation and bitumen mining operation need not be immediately adjacent to each other, provided that the two operations are appropriately located to allow transportation of fluids from one location to another with an acceptable level of heat loss. When the thermal oil recovery operation and the mining operation are located at a distance from each other, practical considerations for heat recovery will include the amount of heat loss experienced over the distance a fluid is required to travel, as well as the energy and infrastructure required to permit travel of fluid over the requisite distance. The amount of insulation in the pipeline used for transferring heated fluids between operations can be a factor that renders the integrated system practical when there is a long distance between operations. Other unpredictable economic factors, such as fluctuations in the cost of purchased natural gas, may also be taken into consideration when considering the practical cost savings realized by the integrated system.

SAGD temperature may be determined or controlled for optimum reuse of produced thermal energy. In one embodiment of the invention, several parameters may be considered or incorporated to control the temperature of fluids produced in a SAGD operation. Because water makes up the majority of the produced fluid, surface pressure would be a determinant of the production temperature, rendering it similar to the saturated temperature of water. By adjusting the surface pressure at the inlet of the donor fluid acceptor fluid heat exchanger to be similar to the reservoir pressure, temperature reductions due to the thermodynamic properties of water or oil will be minimized.

A mechanical lift system may be used for SAGD production to transit fluids up the wellbore. Exemplary mechanical lift systems include a rod pump or rotary pump. A gas lift system would not be as applicable in this instance, as gas would vaporize water, absorb water vapor, and cool the production stream below the temperature that could be sustained with a different lift system.

Delivery pressure may be controlled so that produced fluids arrive at the operation with similar pressure to that of the bottom hole pump intake pressure. Heat loss during transit up the wellbore is relatively small, and thus a mechanical lift system that can ensure a surface pressure equivalent to reservoir pressure would result in a surface temperature only marginally different than reservoir temperature. A lower surface pressure would indicate a lower surface temperature (consistent with the saturation curve of water), but would also result in a higher fraction of water vapor at the surface than at the reservoir depth. Given these considerations, the surface temperature can be controlled to the desired range (between about 100-220° C.) to achieve the desired conditions.

Conventional SAGD surface facilities may be designed for a lower pressure, to support a lower temperature of around 130° C., for example. While such operations can be retrofitted in some instances to re-use low grade heat produced, it may be desirable in other instances to design or retro-fit a plant to have a high pressure capacity so as to achieve higher temperatures (for example from or 150-220° C., or at a level in excess of 200° C.). Maintaining a consistent high pressure at the inlet to this system, comparable to that of the bottom hole pump intake pressure can result in higher efficiency.

By controlling the production pressure of the SAGD operation, a high temperature fluid is produced, which enables production of power. Waste heat from the power generating cycle can be utilized as a heat sink to meet in whole or in part the heat requirements of a bitumen mining operation. Further, any low grade waste heat produced in the bitumen treating process may optionally be recovered and used in the method and system described.

Arrival temperature can thus be set by the reservoir temperature. For example, the reservoir temperature could be intentionally maintained near 200° C. This sustained high temperature can be used to generate power that is economically advantageous. Maintaining a higher fluid temperature from the SAGD operation permits more economically effective use of the waste energy produced for power generation. The higher temperature can be transferred to a working fluid to generate power through any method acceptable in the geothermal industry. For example, power can be produced through use of an Organic Rankine Cycle (ORC); an ammonia-water system (Kalina® Cycle), through direct expansion through a steam turbine, etc. Further, direct transfer of heat to a fluid in need of heating is an alternative method of utilizing heat formed in the SAGD operation.

Whether waste heat is converted to power for use in a bitumen mining operation, or used in direct heat exchange with the water to be heated in a bitumen mining operation, the end result is that the heat normally considered as waste heat from the power cycles of a SAGD operation can be effectively utilized as a heat source for bitumen mining.

FIG. 1 illustrates a flow chart of the main steps of the method of recovering heat from a thermal oil recovery operation for use in a bitumen mining operation according to an embodiment of the invention. In the initial step 12 a heated donor fluid resulting from a thermal oil recovery operation is accessed. Subsequently, an acceptor fluid is heated 14 for use in a bitumen mining operation through proximal heat exchange with the heated donor fluid to produce a heated acceptor fluid. Then, the heated acceptor fluid is directed 16 to a bitumen mining operation.

Figure 2:
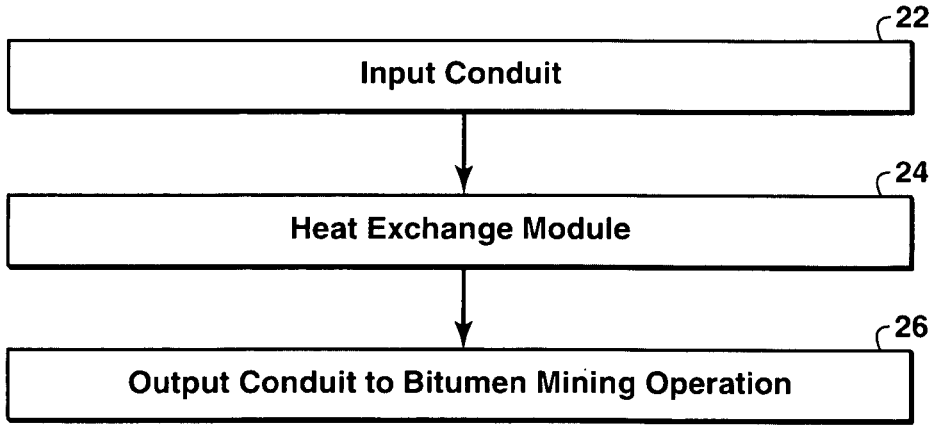
FIG. 2 is a schematic representation of the system described herein.

FIG. 2 illustrates a system for using heat produced in a thermal oil recovery operation to heat a fluid for a bitumen mining operation according to an embodiment of the invention. The system comprises a heat exchange module 24 for transferring heat from a heated donor fluid produced in a thermal oil recovery operation to an acceptor fluid to produce a heated acceptor fluid for use in a bitumen mining operation. The heat exchange module is located proximal to the heated donor fluid. An input conduit 22 is included in the system, along which the acceptor fluid flows to the heat exchange module. An output conduit 24 is included in the system. The heated acceptor fluid flows along the output conduit and is directed from the heat exchange module to a bitumen mining operation for later use.

Figure 3:
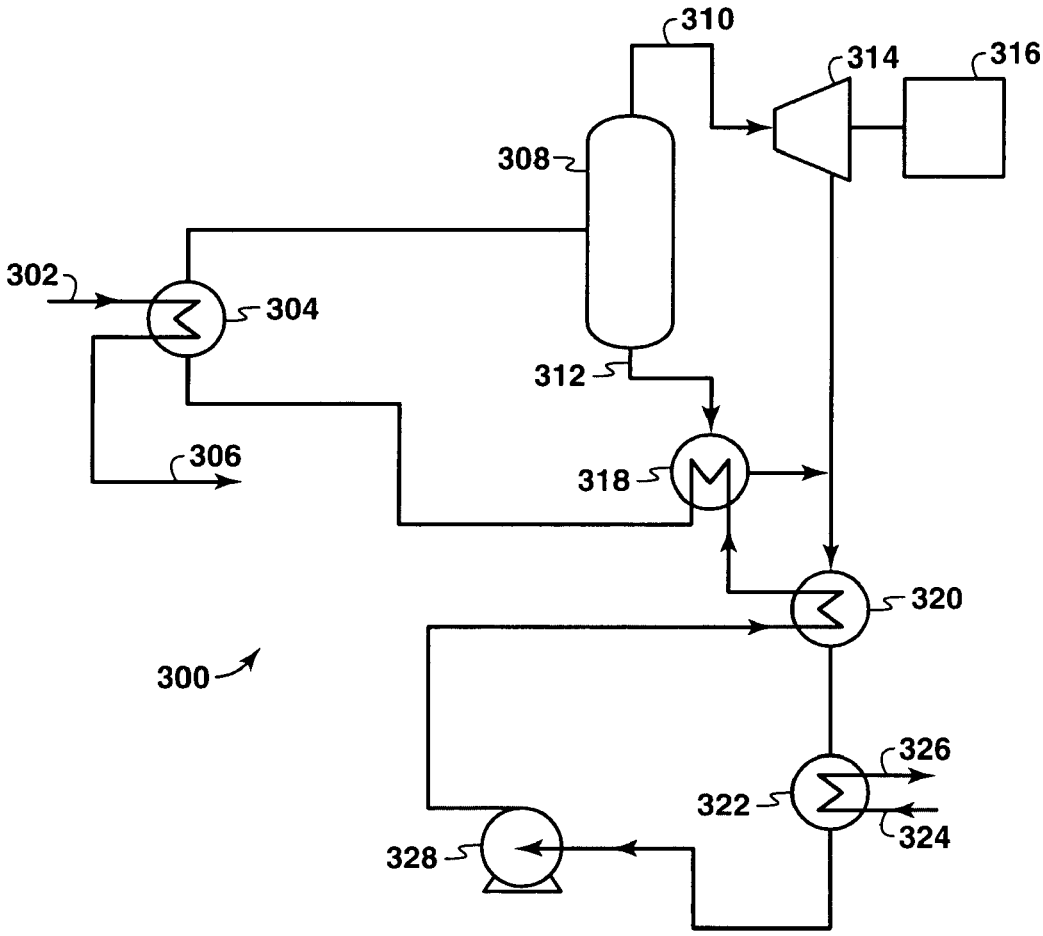
FIG. 3 is a schematic illustration of an embodiment of an integrated heat exchange and power generation system that integrates SAGD waste heat with bitumen mining water heating.

FIG. 3 is a schematic illustration of an embodiment of an integrated heat exchange and power generation system. This figure focuses primarily on the heat exchange module of the system of the invention. In this embodiment, the system integrates SAGD waste heat with bitumen mining water heating through conversion of excess heat via a Kalina® Cycle process. The integrated heat exchange and power generation system 300 uses fluids heated during SAGD production to warm cold water that is intended for bitumen mining operations. A SAGD operation produces fluids, such as a bitumen-water mix, under pressure at a temperature of about 200° C. entering the system at input 302. Heat from this fluid is transferred into the system 300 at exchanger 304, which ultimately results in a cooled fluid production at output 306. The cooled fluid may go on to bitumen mining process, or may be re-used in the SAGD operation. Fluids heated by the exchanger 304 are in this instance a mixture of ammonia and water. These fluids are then transferred to a separator 308 in which ammonia-rich vapor 310 and water-rich liquid 312 are separated.

The ammonia-rich vapor 310 is drawn off and forwarded to turbine 314 for power generation via a generator 316, while water-rich liquid 312 is directed to a liquid exchanger 318, after which it is re-mixed with the ammonia-rich vapor discharged from the turbine 314 to appropriate proportions selected for optimal conditions. Heat from this combined flow can be recovered at a recuperator 320. As vapor is condensed to a liquid form at condenser 322, cold water, for example derived from lake or river water, can be heated via the cold water input 324, and removed via the warm water output 326 for use in a bitumen mining operation. Once condensed, the ammonia-water mixture can be pumped back to the recuperator via pump 328, then to the liquid exchanger 318 and finally to exchanger 304, completing the cycle.

By controlling production pressure of a SAGD operation, a high temperature fluid is produced, and this allows generation of an economically advantageous source of power, for example, via the Kalina® cycle, or a comparable power generation cycle.

Although the Kalina® cycle using a water/ammonia mixture is exemplified here, other fluids can be used in a comparable system, such as organic solvents pentane or propane, provided the desired effect of heat transfer can be accomplished in some manner.

Integration of this power generating cycle with the use of waste heat to raise the temperature of water used in a bitumen mining operation will result in an advantageous use of heat that would otherwise have been wasted.

Geographical proximity of the SAGD operation and the bitumen mining operation is a consideration that can be used in the determination of optimum conditions of the system. For example, if the two operations are not immediately proximal to each other, the distance over which the water to be heated must travel between the location of the heat exchange aspect of the system and the bitumen mining can be taken into consideration to optimize the heating temperature, accounting for heat loss in transit.

Seasonal temperatures and conditions can also be taken into consideration to optimize the process conditions. For example, if water to be used in a bitumen mining operation is drawn from a river under winter conditions, the temperature will be near freezing, and a higher amount of heat transferred in during heat exchange in the system may be desirable. Similarly, seasonal outdoor temperatures can also be taken into consideration to determine the extent to which transferred heat may dissipate in any transit required between the heat exchange and the bitumen mining operation.

Figure 4:
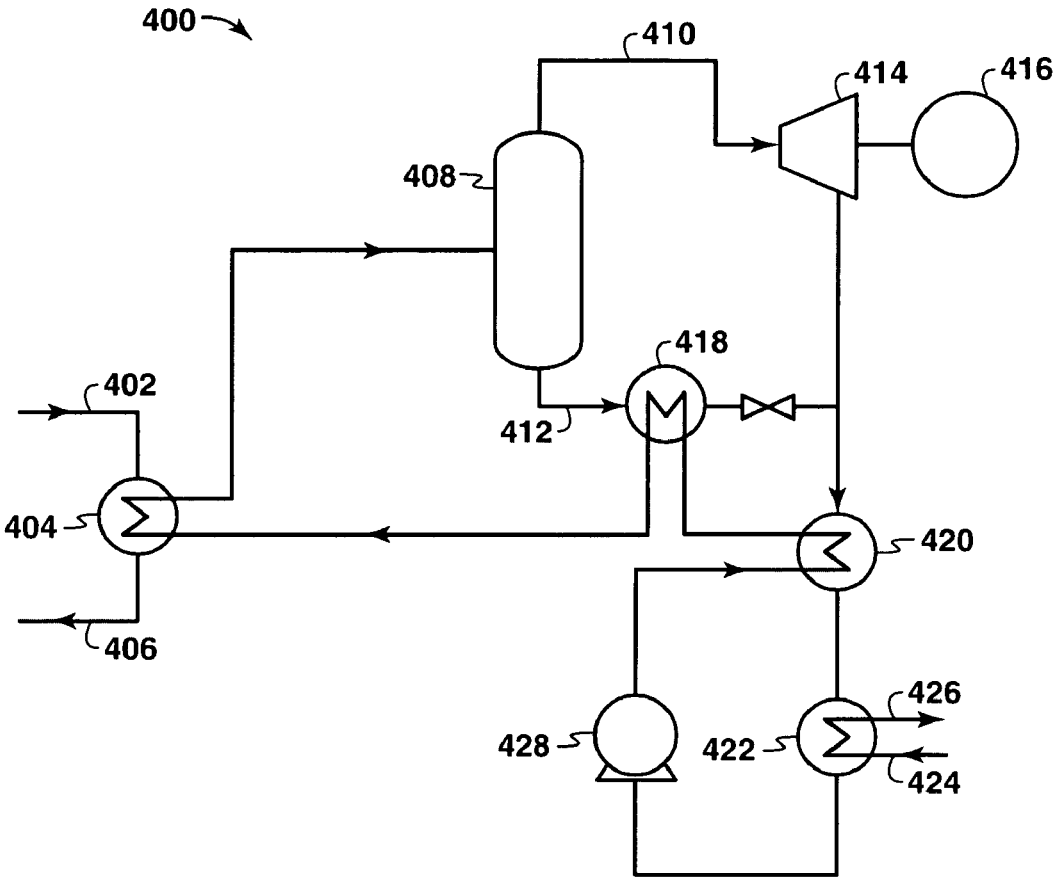
FIG. 4 illustrates performance of a PRIOR ART exemplary Kalina® Cycle at a geothermal power plant located in Husavik, Iceland, provided herein as a comparative example.

FIG. 4 illustrates performance of an exemplary Kalina® Cycle in more detail, intended for use in power generation. The Kalina® Cycle system 400 depicted is based on a geothermal power plant located in Husavik, Iceland. While the use of heat exchange in this exemplary system in Iceland does not directly relate to oil recovery or bitumen mining operations, the premise and benefit of the system can be illustrated through the net electricity output generated. As a power input, a hot geothermal fluid, or brine, enters the system at input 402 at a temperature of about 121° C., and at a rate of about 90 kg/s. Heat from this fluid is transferred into the system 400 at exchanger 404, which ultimately results in a cooled fluid production at output 406. The fluid emanating from the output is maintained at about 80° C., due to the requirements at this particular power plant. The cooled fluid in this instance simply goes on to other external users. The fluid heated by the exchanger 404 is a mixture of ammonia and water.

The fluid mixture, in this instance having 0.81 $NH_3$ content at 118° C. and at a pressure of 31 bar, is transferred to a separator 408 in which ammonia-rich vapor 410 and water-rich liquid 412 are separated.

The ammonia-rich vapor 410 is drawn off at a rate of about 11 kg/s and forwarded to turbine 414 for power generation via a generator 416, capable of producing about 1950 kW. While water-rich liquid 412 is directed to a liquid exchanger 418 after which water and ammonia are again re-mixed with the ammonia-rich vapor derived from the turbine 414 to appropriate proportions selected for optimal conditions. Heat from this combined flow is recovered by a recuperator 420. As vapor is condensed to a liquid form at condenser 422, cooling water flows through the condenser at a rate of about 173 kg/s. The cooling water absorbs heat, and may be heated from about 5° C. to about 24° C. The heating of the cooling water between input 424 and output 426 is not, in this instance, used for any application relating to oil recovery or bitumen mining operations. Once condensed, ammonia-water mixture at about 12° C. is provided to the recuperator via pump 428, utilizing energy in an amount of approximately 130 kW. The power input from hot geothermal fluid is in the range of about 15,700 kW, whereas the power output of this particular plant is about 1700 kW of electricity (net) and 14,000 kW attributable to cooling water.

The power generation from this power plant in Iceland can be used to illustrate that power can be generated, and provides typical values for the conditions of this plant. The input temperature of 121° C. in this comparative example would be surpassed by those instances in which a higher SAGD temperature is deemed desirable, possibly at a level of up to about 200° C. Adjusting for this higher temperature, and the fluid flow rate resulting from a 15,000 bbl/d bitumen operation, it can be estimated that 6 MW of electricity could be generated for on-site use or export, according to an embodiment of the invention.

The Kalina® cycle is advantageously very efficient when used within the expected range of temperatures described herein. Further, an advantage of using an ammonia and water mix is that this option allows additional optimization to be realized when designing and operating the system, as the proportions of ammonia and water in the mixture can be optimized according to the actual temperature of the heat source.

Advantageously, when the two or more recovery methods (for example, thermal recovery and bitumen mining) are integrated for heat recovery, many additional options and advantages become available. For example, liquid phase blow down from a Once Through Steam Generator (OTSG) in a SAGD system can be added to the power cycle to increase peak temperature and total heat input into the system. Further, OTSG flue gas heat could be captured and utilized to increase total power generation. Additionally, hot diluted bitumen (or "dilbit") which may require cooling to meet pipeline specifications can result in removal of heat that can be integrated into the power cycle or used for direct heat exchange with cold extraction water.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

The invention claimed is:

1. A method of recovering heat from a thermal oil recovery operation for use in a bitumen mining operation comprising:

accessing a heated donor fluid resulting from a thermal oil recovery operation, wherein the temperature of the heated donor fluid ranges from 130 to 350° C.;

heating an acceptor fluid for use in a bitumen mining operation through proximal heat exchange with the heated donor fluid to produce a heated acceptor fluid; and directing the heated acceptor fluid to a bitumen surface mining operation.

2. The method of claim 1, wherein the thermal oil recovery operation comprises steam assisted gravity drainage (SAGD); solvent assisted SAGD; cyclic steam stimulation (CSS); combined steam and vapor extraction process (SAVEX); steam flood; steam drive; solvent assisted CSS; liquid addition to steam for enhanced recovery (LASER); or an in situ combustion operation.

3. The method of claim 2 wherein the thermal oil recovery operation comprises a SAGD operation.

4. The method of claim 3 wherein the heated donor fluid comprises an aqueous solution under pressure.

5. The method of claim 3 wherein accessing the heated donor fluid comprises mechanically lifting the heated donor fluid from a wellbore in a SAGD operation.

6. The method of claim 1, wherein the temperature of the heated donor fluid ranges from 150 to 220° C.

7. The method of claim 1, additionally comprising the step of deriving heat from a supplemental heat donating source for heating the acceptor fluid, said supplemental heat donating source being derived from either a thermal oil recovery operation or a bitumen mining operation.

8. The method of claim 7, wherein the supplemental heat donating source comprises liquid phase blow down from a Once Through Steam Generator (OTSG); OTSG flue gas; or hot diluted bitumen.

9. The method of claim 1 wherein the acceptor fluid comprises water derived from a surface source, or a sub-surface source.

10. The method of claim 1 wherein the step of heating an acceptor fluid comprises a power generating cycle.

11. The method of claim 10, wherein the power generating cycle comprises an Organic Rankine Cycle (ORC), an ammonia-water system, or expansion through a turbine.

12. The method of claim 11 wherein the power generating cycle comprises an ammonia-water system.

13. The method of claim 12 wherein the ammonia-water system:

a) derives a heated donor fluid from SAGD production at a temperature of from 150-220° C.;

b) derives power when ammonia-rich vapor is directed to a turbine;

c) heats the acceptor fluid through heat exchange during condensation of ammonia-rich vapor;

d) produces a fluid from the heated donor fluid, after heat exchange with an ammonia-water mixture, that is usable in a bitumen mining operation; or e) a combination of two or more of a), b), c) or d).

14. The method of claim 1 wherein directing the heated acceptor fluid to a bitumen mining operation comprises transporting the heated acceptor fluid by pipeline.

15. A system for using heat produced in a thermal oil recovery operation to heat a fluid for a bitumen mining operation, the system comprising:

a heat exchange module for transferring heat from a heated donor fluid produced in a thermal oil recovery operation to an acceptor fluid to produce a heated acceptor fluid for use in a bitumen mining operation, the heat exchange module being located proximal to the heated donor fluid, wherein the temperature of the heated donor fluid ranges from 130 to 350° C.;

an input conduit along which the acceptor fluid flows to the heat exchange module; and an output conduit along which the heated acceptor fluid is directed from the heat exchange module to a bitumen surface mining operation.

16. The system of claim 15, wherein the heat exchange module comprises a power generating cycle.

17. The system of claim 16, wherein the power generating cycle comprises an Organic Rankine Cycle (ORC), an ammonia-water system, or expansion through a turbine.

18. The system of claim 17, wherein the power generating cycle comprises an ammonia-water system.

19. The system of claim 18, wherein the ammonia-water system comprises a condenser for condensing ammonia-rich vapor, the condenser receiving acceptor fluid from the input conduit, and producing heated acceptor fluid for release to the output conduit.

20. The system of claim 15 wherein the acceptor fluid comprises water from a river.

21. The system of claim 15 additionally comprising the thermal oil recovery operation.

22. The system of claim 21, wherein the thermal oil recovery operation comprises steam assisted gravity drainage (SAGD); solvent assisted SAGD; cyclic steam stimulation (CSS); combined steam and vapor extraction process (SAVEX); steam flood; steam drive; solvent assisted CSS; liquid addition to steam for enhanced recovery (LASER); or an in situ combustion operation.

23. The system of claim 22, wherein the thermal oil recovery operation comprises steam assisted gravity drainage (SAGD) operation.

24. The system of claim 23, wherein the steam assisted gravity drainage (SAGD) operation comprises a mechanical lift to transport the heated donor fluid from a wellbore.

25. The system of claim 24, wherein the mechanical lift comprises a rod pump or rotary pump.

26. The system of claim 15 wherein the heated donor fluid comprises an aqueous solution under pressure.

* * * * *